US008403581B2

(12) United States Patent
Crucs

(10) Patent No.: US 8,403,581 B2
(45) Date of Patent: Mar. 26, 2013

(54) CONDIMENT PACKET HAVING A SPREADING APPARATUS, AND METHOD OF USE THEREOF

(75) Inventor: Kevin M. Crucs, Copley, OH (US)

(73) Assignee: Crucs Holdings, LLC, Copley, OH (US)

( * ) Notice: Subject to any disclaimer, the term of this patent is extended or adjusted under 35 U.S.C. 154(b) by 0 days.

(21) Appl. No.: 13/342,238

(22) Filed: Jan. 3, 2012

(65) Prior Publication Data

US 2012/0141638 A1 Jun. 7, 2012

Related U.S. Application Data

(62) Division of application No. 12/351,122, filed on Jan. 9, 2009.

(51) Int. Cl.
*B43K 5/14* (2006.01)

(52) U.S. Cl. ..... 401/132

(58) Field of Classification Search ..... 401/132–135, 401/261; 206/223; 426/392
See application file for complete search history.

(56) References Cited

U.S. PATENT DOCUMENTS

| | | | | |
|---|---|---|---|---|
| 1,705,970 | A | 3/1929 | Ford | |
| 4,138,014 | A * | 2/1979 | Bouman | 206/542 |
| 4,268,531 | A | 5/1981 | Whiting, Jr. | |
| 4,648,506 | A | 3/1987 | Campbell | |
| 4,797,309 | A | 1/1989 | Kammerer et al. | |
| 4,930,637 | A * | 6/1990 | DeRoseau | 206/541 |
| 5,111,932 | A | 5/1992 | Campbell | |
| 6,719,140 | B1 * | 4/2004 | Rinsler | 206/541 |
| 6,935,783 | B2 | 8/2005 | Carter | |
| 2004/0146226 | A1 | 7/2004 | Wolak et al. | |
| 2006/0156553 | A1 | 7/2006 | Ensenat Alvarez | |
| 2006/0233928 | A1 | 10/2006 | Wysocki et al. | |
| 2008/0092395 | A1 | 4/2008 | Belanger et al. | |
| 2008/0205971 | A1 | 8/2008 | Liberatore | |

* cited by examiner

*Primary Examiner* — Huyen Le
(74) *Attorney, Agent, or Firm* — Hahn Loeser & Parks LLP

(57) ABSTRACT

A condiment packet having a spreading apparatus, and a method of use thereof. The condiment packet includes a substantially flat, sealed pouch containing a condiment. The condiment packet further includes a spreading apparatus being within the sealed pouch. The spreading apparatus may be used to spread the condiment over a food substance once the condiment is squeezed onto the food substance and once a portion of the spreading apparatus is exposed.

10 Claims, 15 Drawing Sheets

CONDIMENT PACKET HAVING A SPREADING APPARATUS, AND METHOD OF USE THEREOF

This U.S. patent application is a divisional application of U.S. patent application Ser. No. 12/351,122 filed on Jan. 9, 2009, which is expressly incorporated herein by reference.

TECHNICAL FIELD

Certain embodiments of the present invention relate to condiment packets or packages. More particularly, certain embodiments relate to condiment packets or packages providing a means for spreading a condiment.

BACKGROUND

Many restaurants and cafeterias provide certain condiments such as tomato ketchup, mustard, mayonnaise and similar items in individual condiment packets or packages. The packets generally have a first side wall and a second side wall that are sealed to each other around their respective perimeters to form a sealed pouch. Such condiment packets are often made of layers of plastic, cellophane, and aluminum foil. A user typically opens an end of the packet and squeezes the packet to release the condiment onto a food substance. However, the user may subsequently desire to further spread the condiment more uniformly over the food substance.

Further limitations and disadvantages of conventional, traditional, and proposed approaches will become apparent to one of skill in the art, through comparison of such approaches with the subject matter of the present application as set forth in the remainder of the present application with reference to the drawings.

SUMMARY

An embodiment of the present invention comprises a method of opening and using a condiment packet. The method includes opening a proximal end of a condiment packet containing a condiment and a spreading apparatus. The method further includes squeezing the condiment packet to release the condiment out of the proximal end of the condiment packet and onto a food substance. The method also includes gripping an outer surface of the condiment packet at a first portion of the spreading apparatus within the condiment packet, and peeling back two sides of the condiment packet exposing a second portion of the spreading apparatus. The method further includes spreading the condiment over the food substance using the second portion of the spreading apparatus while continuing to grip the outer surface of the condiment packet at the first portion of the spreading apparatus. The first portion of the spreading apparatus may be located substantially along at least a portion of an internal edge of the condiment packet and is affixed thereto. The spreading apparatus may be substantially more rigid than the condiment packet.

Another embodiment of the present invention comprises a condiment packet. The condiment packet includes a substantially flat, sealed pouch having two prominent sides and containing a condiment. The condiment packet further includes a spreading apparatus being within the sealed pouch, wherein at least a portion of the spreading apparatus is affixed to an internal portion of the sealed pouch such as, for example, along at least a portion of an internal edge of the sealed pouch formed by the two prominent sides. The condiment packet may further include a sealing strip removably affixed at a proximal end of the condiment packet. The condiment packet may also include two peeling tabs, one on either prominent side of the condiment packet, at a same corner of the condiment packet. The condiment packet may further include a peel-back crease on both prominent sides of the condiment packet wherein each peel-back crease defines a boundary to which the prominent sides may be peeled back to. The two prominent sides may be made of at least one of plastic, cellophane, and aluminum foil and the spreading apparatus may be more rigid than the prominent sides.

A further embodiment of the present invention comprises a method of opening and using a condiment packet. The method includes opening one end or one corner of a condiment packet containing a condiment and a spreading apparatus having at least a first portion and a second portion. The method further includes squeezing the condiment packet to release the condiment and to slide the first portion of the spreading apparatus out of the open end or corner of the condiment packet. The method also includes gripping an outer surface of the condiment packet at the second portion of the spreading apparatus, the second portion still being within the condiment packet. The method further includes spreading the condiment over a food substance using the first portion of the spreading apparatus while continuing to grip the outer surface of the condiment packet at the second portion of the spreading apparatus. The second portion of the spreading apparatus may be wider than the open end or corner of the condiment packet such that the second portion of the spreading apparatus is unable to exit the open end or corner of the condiment packet. The spreading apparatus may be substantially more rigid than the condiment packet.

Another embodiment of the present invention comprises a condiment packet. The condiment packet includes a substantially flat, sealed pouch containing a condiment. The condiment packet further includes a spreading apparatus being free-floating within the sealed pouch and having at least a first portion and a second portion, wherein the second portion is wider than the first portion. The condiment packet may also include at least one sealing strip removably affixed to at least one end or corner of the condiment packet. A first end of the sealed pouch may be narrower than a second end of the sealed pouch. Alternatively, the first end of the sealed pouch may be substantially a same width as the second end. The spreading apparatus may further include a third portion, wherein the second portion may be between the first portion and the third portion within the condiment packet, and wherein the second portion is wider than the third portion. The sealed pouch of the condiment packet may be made of at least one of plastic, cellophane, and aluminum foil. The spreading apparatus may be made of a plastic material that is more rigid than the sealed pouch.

These and other novel features of the subject matter of the present application, as well as details of illustrated embodiments thereof, will be more fully understood from the following description and drawings.

DETAILED DESCRIPTION

Figure 1B:
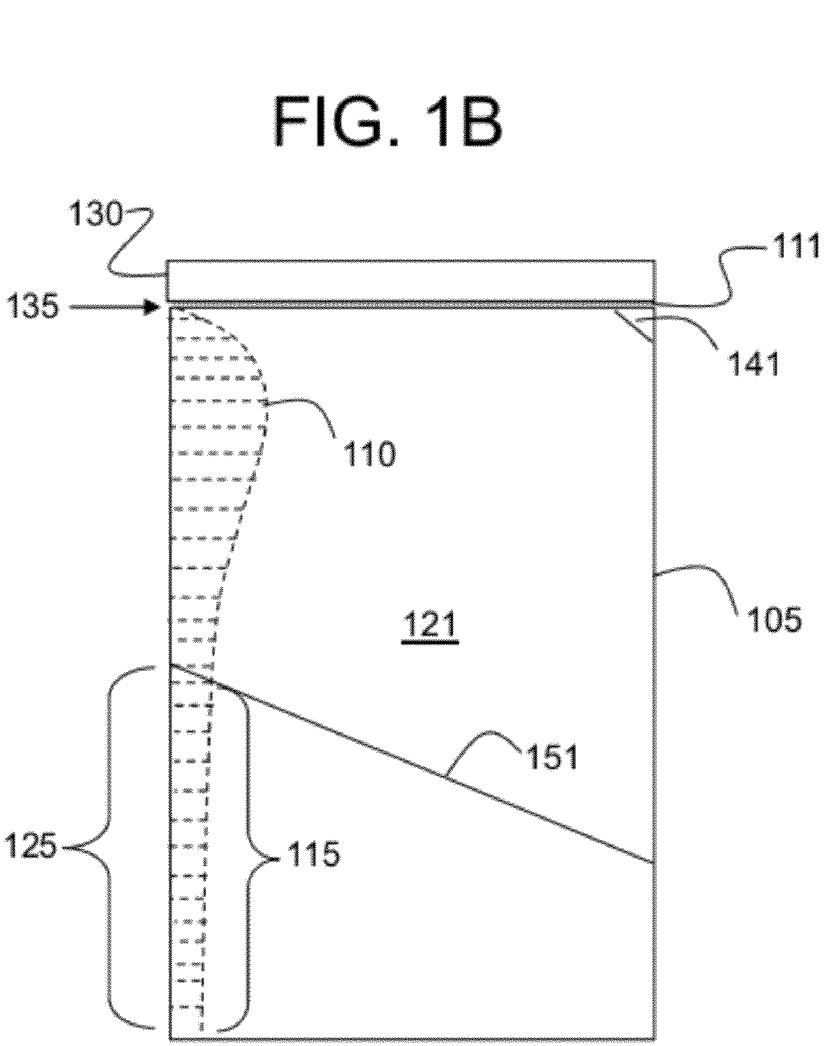
FIGS. 1A-1B illustrate an example of an embodiment of a condiment packet having a spreading apparatus therein.
Figure 1A:
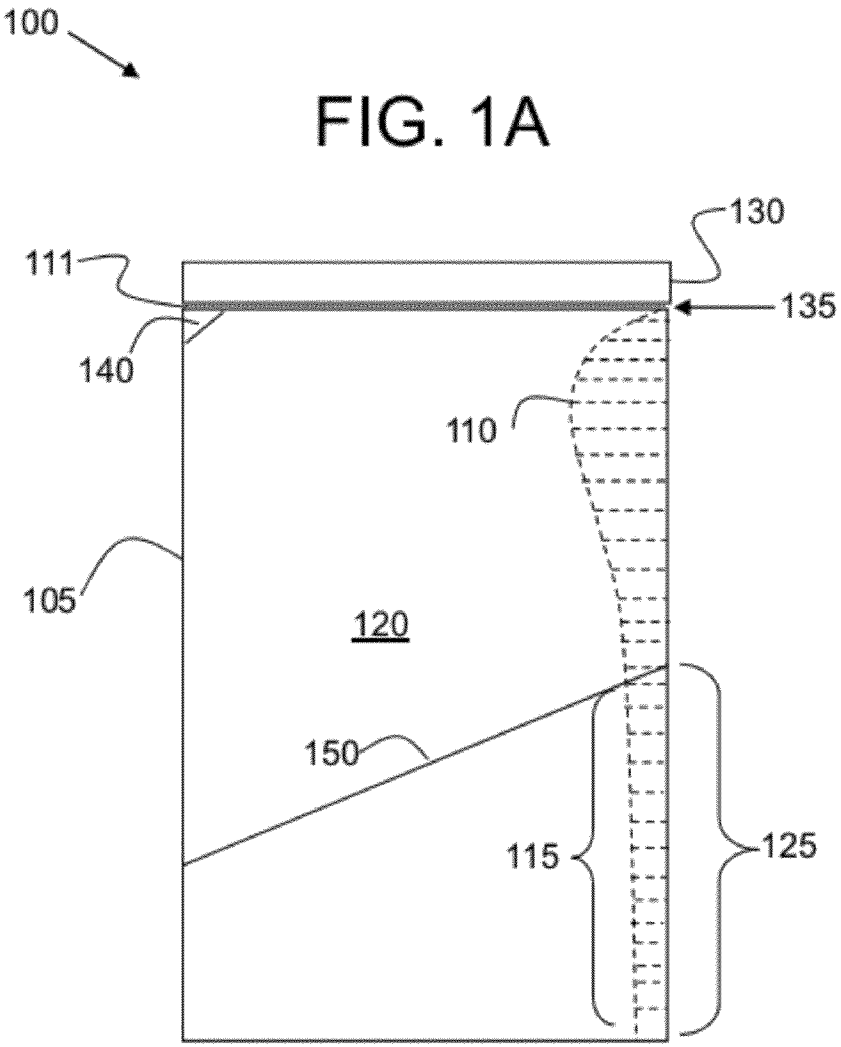

FIGS. 1A-1B illustrate an example of an embodiment of a condiment packet 100 having a spreading apparatus 110 therein. FIG. 1A shows a first side 120 of the condiment packet 100 and FIG. 1B shows an opposite side 121 of the condiment packet 100 when the condiment packet 100 is flipped horizontally. The condiment packet 100 is made to contain a condiment (e.g., tomato ketchup, mustard, or mayonnaise) within the condiment packet 100.

The condiment packet 100 includes a substantially flat and rectangular sealed pouch 105 having two prominent sides 120 and 121 that are sealed together along their respective perimeters. In accordance with other embodiments, additional less prominent sides may be present as well, for example, giving the pouch 105 a more substantial thickness. A first prominent side 120 is shown in FIG. 1A and a second prominent side 121 is shown in FIG. 1B. The spreading apparatus 110 is sealed within the condiment packet 100 and a portion 115 of the spreading apparatus 110 is affixed to the sealed pouch along a portion 125 of an internal edge of the sealed pouch formed by the two prominent sides 120 and 121. Affixing the spreading apparatus 110 to the internal edge portion 125 prevents the spreading apparatus 110 from coming removed from the condiment packet 100 when squeezing the condiment out of the packet 100. In accordance with other embodiments, the spreading apparatus 110 may be affixed to an internal surface of one of the prominent sides instead of to an internal edge.

In accordance with an embodiment of the present invention, the spreading apparatus 110 is substantially more structurally rigid than the pouch 105. The spreading apparatus 110 may be made of a rigid plastic, for example, and the sides 120 and 121 may be made of a flexible plastic having internal surfaces coated with cellophane or aluminum foil, for example.

The condiment packet 100 also includes a sealing strip 130 removably affixed at a proximal end of the condiment packet 100. The sealing strip 130 may be removed by a user tearing along a perforated line 135 between the prominent sides 120 and 121 and the sealing strip 130. Removing the sealing strip 130 opens the sealed pouch 105, allowing the condiment to be squeezed out of the packet 100. The condiment packet 100 also includes two peeling tabs 140 and 141, one peeling tab on each respective prominent side 120 and 121 of the condiment packet 100, at a same corner 111 of the condiment packet 100. The condiment packet 100 also includes peel-back creases 150 and 151 on prominent sides 120 and 121, respectively, of the condiment packet 100. Each peel-back crease 150 and 151 defines a boundary to which the prominent sides 120 and 121 may be peeled back, from the same corner 111, using the two peeling tabs 140 and 141.

Figure 2:
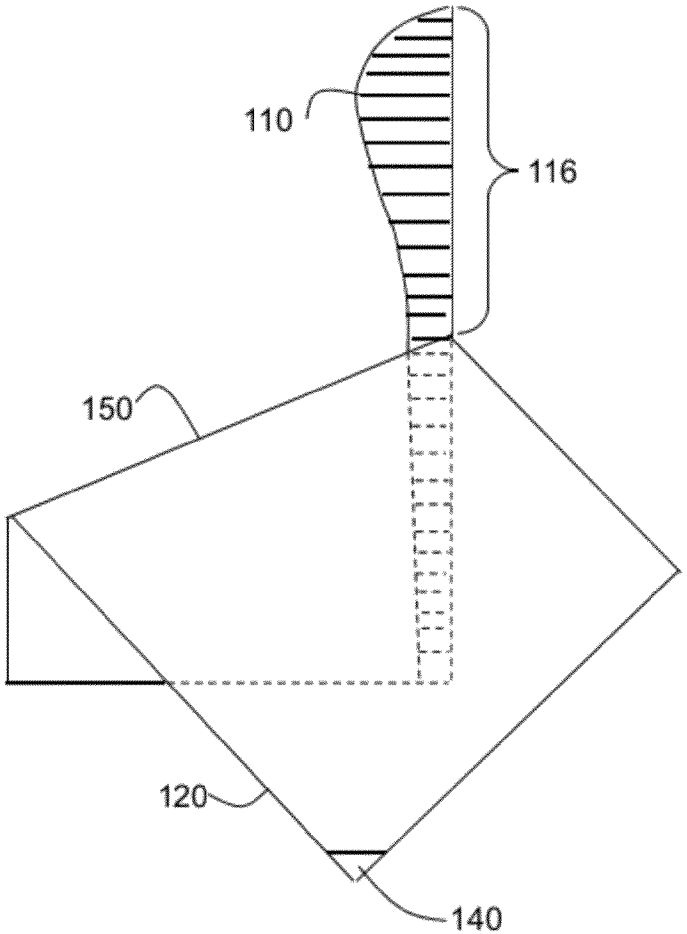
FIG. 2 illustrates the condiment packet of FIGS. 1A-1B, after the condiment packet has been opened, and showing a side peeled back to a crease, and showing a resulting exposed upper portion of the spreading apparatus.

FIG. 2 illustrates the condiment packet 100 of FIGS. 1A-1B, after the condiment packet 100 has been opened, and showing the side 120 peeled back to the crease 150, and showing a resulting exposed upper portion 116 of the spreading apparatus 110. The exposed upper portion 116 of the spreading apparatus 110 may be used to spread the condiment more uniformly across a food substance and may resemble an upper portion of a knife, for example.

Figure 3:
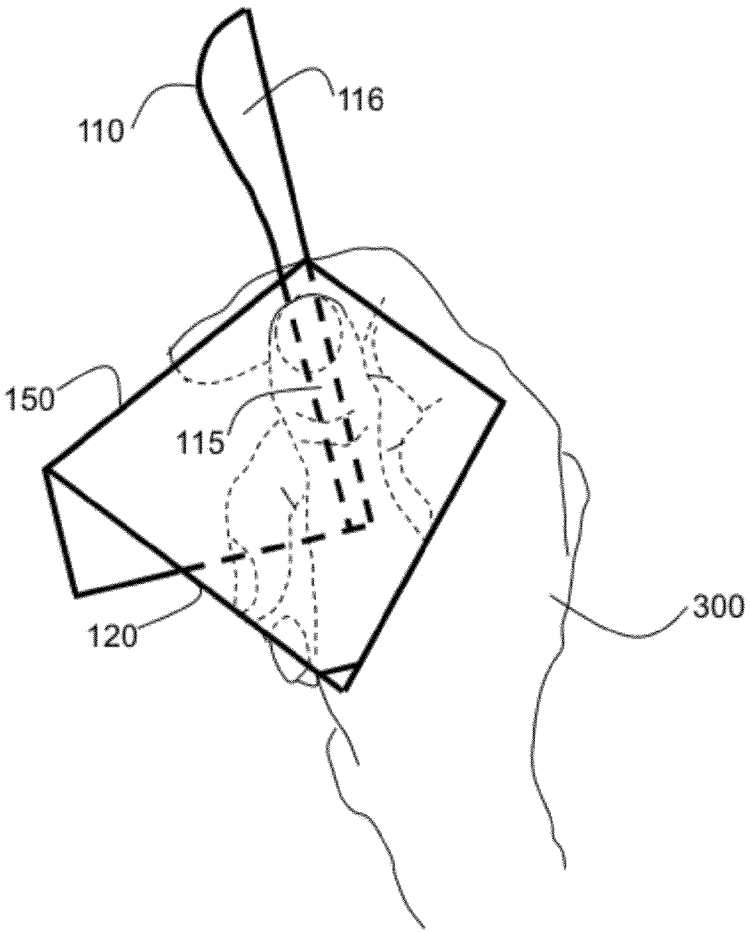
FIG. 3 illustrates how the condiment packet of FIGS. 1A-1B and FIG. 2 may be gripped by a user's hand to accomplish the spreading of the condiment.

FIG. 3 illustrates how the condiment packet 100 of FIGS. 1A-1B and FIG. 2 may be gripped by a user's hand 300 to accomplish the spreading of the condiment. The user may grip the condiment packet at the lower portion 115 of the spreading apparatus 110, for example, between a thumb of the user and an index finger of the user as shown in FIG. 3. In this manner, the user's hand 300 grips the outside surfaces of the sides 120 and 121 of the condiment packet 100 while the inside surfaces of the peeled back portions of the sides 120 and 121 of the condiment packet 100 lay over the user's hand 300 such that residue condiment remaining on the inside surfaces does not come in contact with the user's hand 300.

Figure 4:
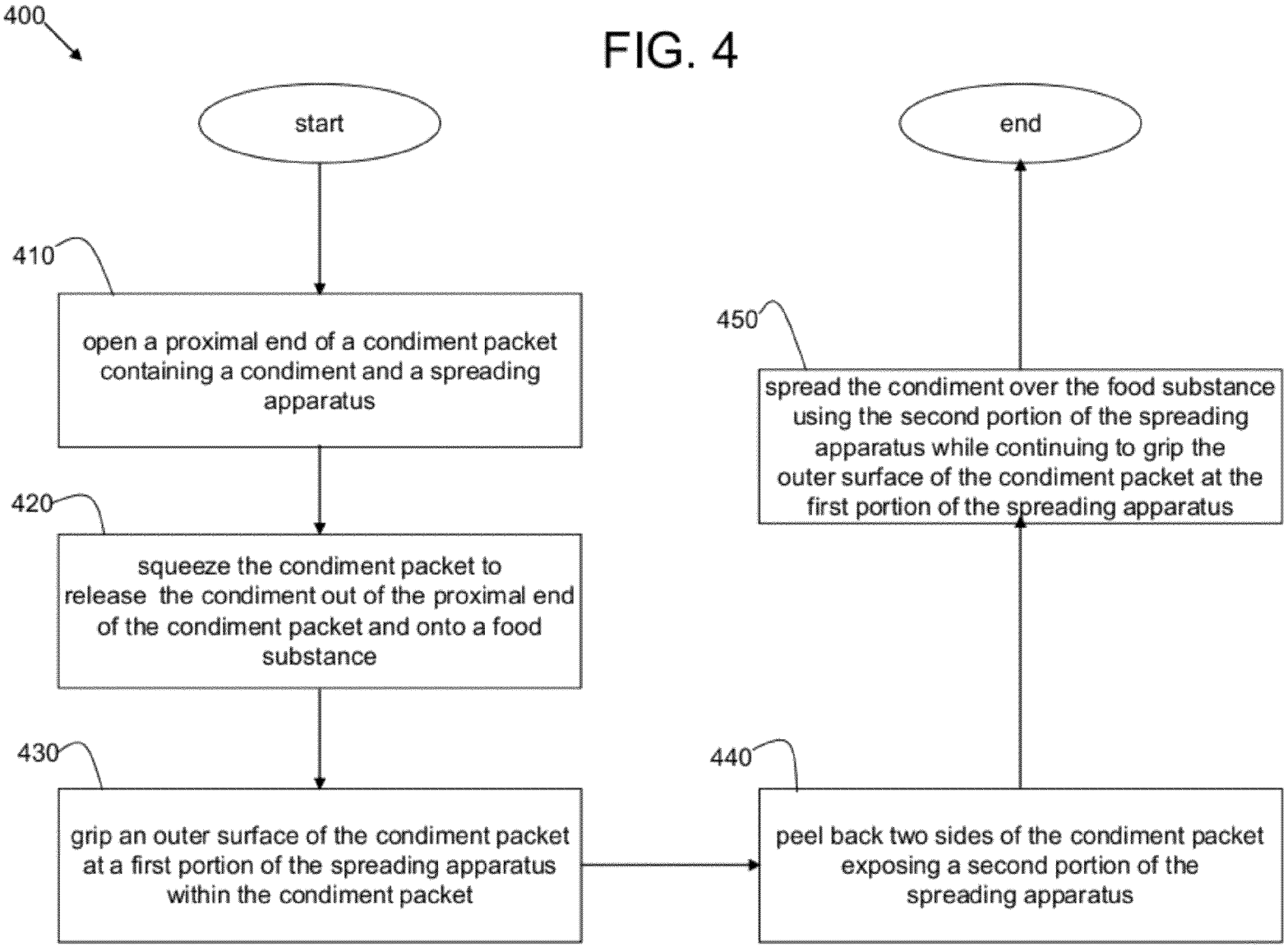
FIG. 4 is a flow chart of an example of an embodiment of a method of opening and using the condiment packet of FIGS. 1A-1B.

FIG. 4 is a flow chart of an example of an embodiment of a method 400 of opening and using the condiment packet 100 of FIGS. 1A-1B. In step 410 of the method 400, open a proximal end of a condiment packet 100 containing a condiment and a spreading apparatus 110 (e.g., by tearing away the sealing strip 130). In step 420, squeeze the condiment packet 100 to release the condiment out of the proximal end of the condiment packet 100 and onto a food substance. In step 430, grip an outer surface of the condiment packet 100 at a first portion 115 of the spreading apparatus 110 affixed within the condiment packet 100. In step 440, peel back two sides 120 and 121 of the condiment packet 100 exposing a second portion 116 of the spreading apparatus 110. In step 450, spread the condiment over the food substance using the second portion 116 of the spreading apparatus 110 while continuing to grip the outer surface of the condiment packet 100 at the first portion 115 of the spreading apparatus 110. When finished spreading the condiment, the entire condiment packet 100, including the spreading apparatus 110, may be properly discarded.

Figure 5A:
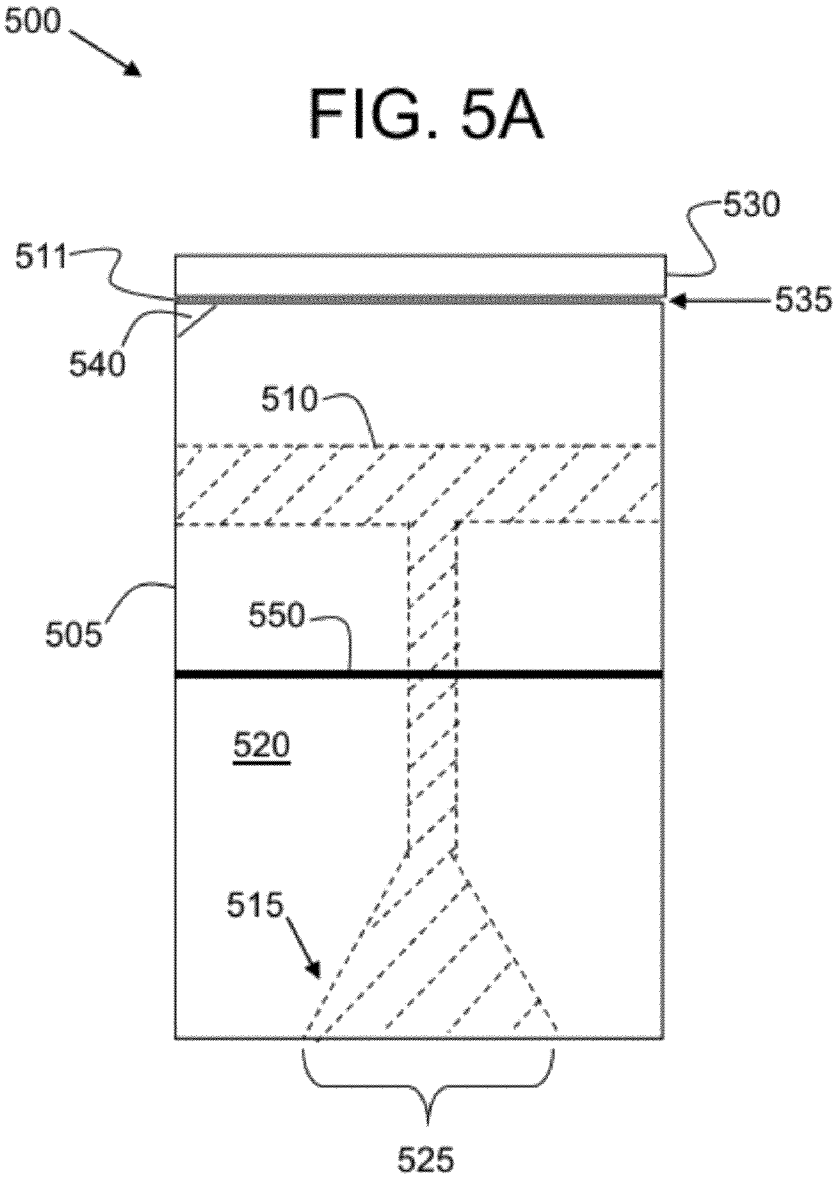
FIGS. 5A-5B illustrate an example of an alternative embodiment of a condiment packet having a spreading apparatus therein.
Figure 5B:
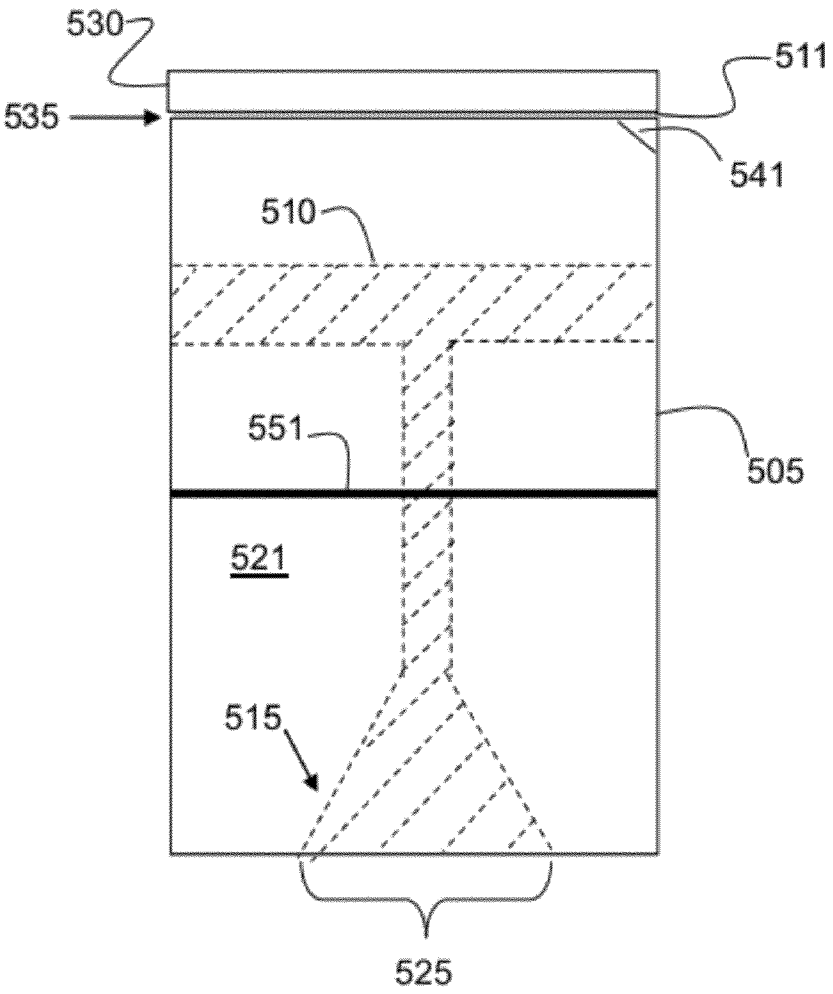

FIGS. 5A-5B illustrate an example of an alternative embodiment of a condiment packet 500 having a spreading apparatus 510 therein. FIG. 5A shows a first side 520 of the condiment packet 500 and FIG. 5B shows an opposite side 521 of the condiment packet 500 when the condiment packet 500 is flipped horizontally. The condiment packet 500 is made to contain a condiment (e.g., tomato ketchup, mustard, or mayonnaise) within the condiment packet 500.

The condiment packet 500 includes a substantially flat and rectangular sealed pouch 505 having two prominent sides 520 and 521 that are sealed together along their respective perimeters. A first prominent side 520 is shown in FIG. 5A and a second prominent side 521 is shown in FIG. 5B. The spreading apparatus 510 is sealed within the condiment packet 500 and a portion 515 of the spreading apparatus 510 is affixed to the sealed pouch 505 along a portion 525 of an internal edge of the sealed pouch 505 formed by the two prominent sides 520 and 521. Affixing the spreading apparatus 110 to the internal edge portion 525 prevents the spreading apparatus 510 from coming removed from the condiment packet 500 when squeezing the condiment out of the packet 500.

In accordance with an embodiment of the present invention, the spreading apparatus 510 is substantially more structurally rigid than the pouch 505. The spreading apparatus 510 may be made of a rigid plastic, for example, and the sides 520 and 521 of the pouch 505 may be made of a flexible plastic having internal surfaces coated with cellophane or aluminum foil, for example.

The condiment packet 500 also includes a sealing strip 530 removably affixed at a proximal end of the condiment packet 500. The sealing strip 530 may be removed by a user tearing along a perforated line 535 between the prominent sides 520 and 521 and the sealing strip 530. Removing the sealing strip 530 opens the sealed pouch 505, allowing the condiment to be squeezed out of the packet 500. The condiment packet 500 also includes two peeling tabs 540 and 541, one peeling tab on each respective prominent side 520 and 521 of the condiment packet 500, at a same corner 511 of the condiment packet 500. The condiment packet 500 also includes peel-back creases 550 and 551 on prominent sides 520 and 521, respectively, of the condiment packet 500. Each peel-back crease 550 and 551 defines a boundary to which the prominent sides 520 and 521 may be peeled back, from the same corner 511, using the two peeling tabs 540 and 541.

Figure 6:
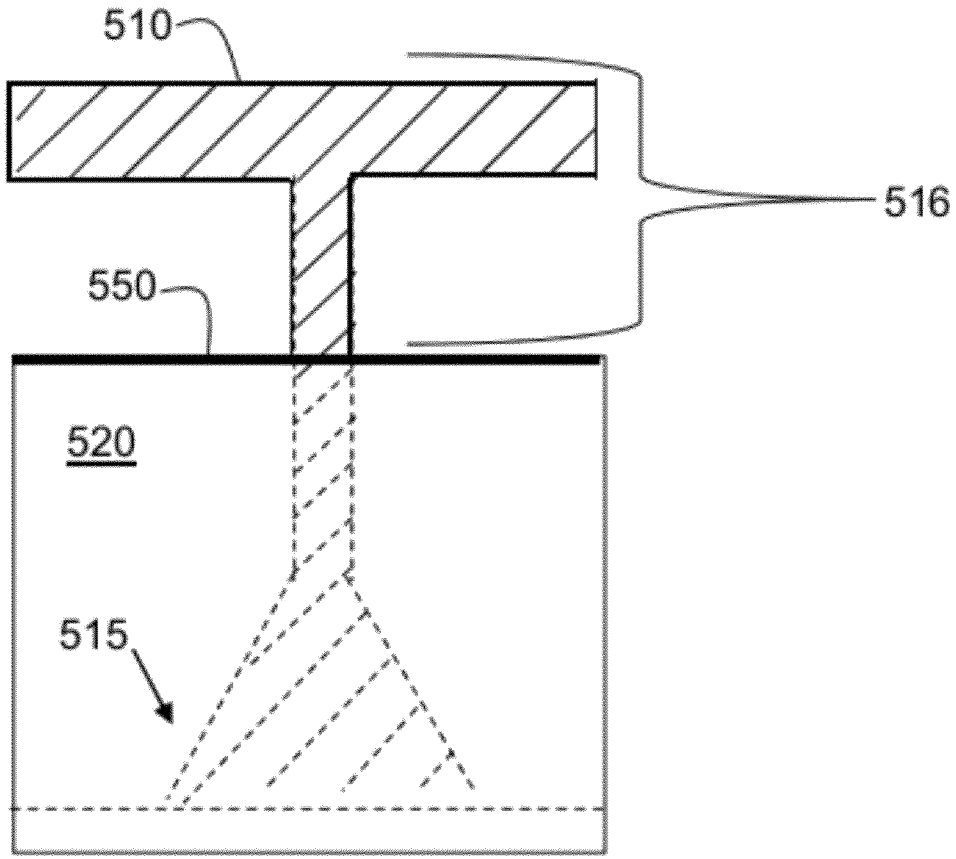
FIG. 6 illustrates the condiment packet of FIGS. 5A-5B, after the condiment packet has been opened, and showing a side peeled back to a crease, and showing a resulting exposed upper portion of the spreading apparatus.

FIG. 6 illustrates the condiment packet 500 of FIGS. 5A-5B, after the condiment packet 500 has been opened, and showing the side 520 peeled back to the crease 550, and showing a resulting exposed upper portion 516 of the spreading apparatus 510. The exposed upper portion 516 of the spreading apparatus 510 may be used to spread the condiment more uniformly across a food substance and may resemble a T-shape, for example.

Figure 7:
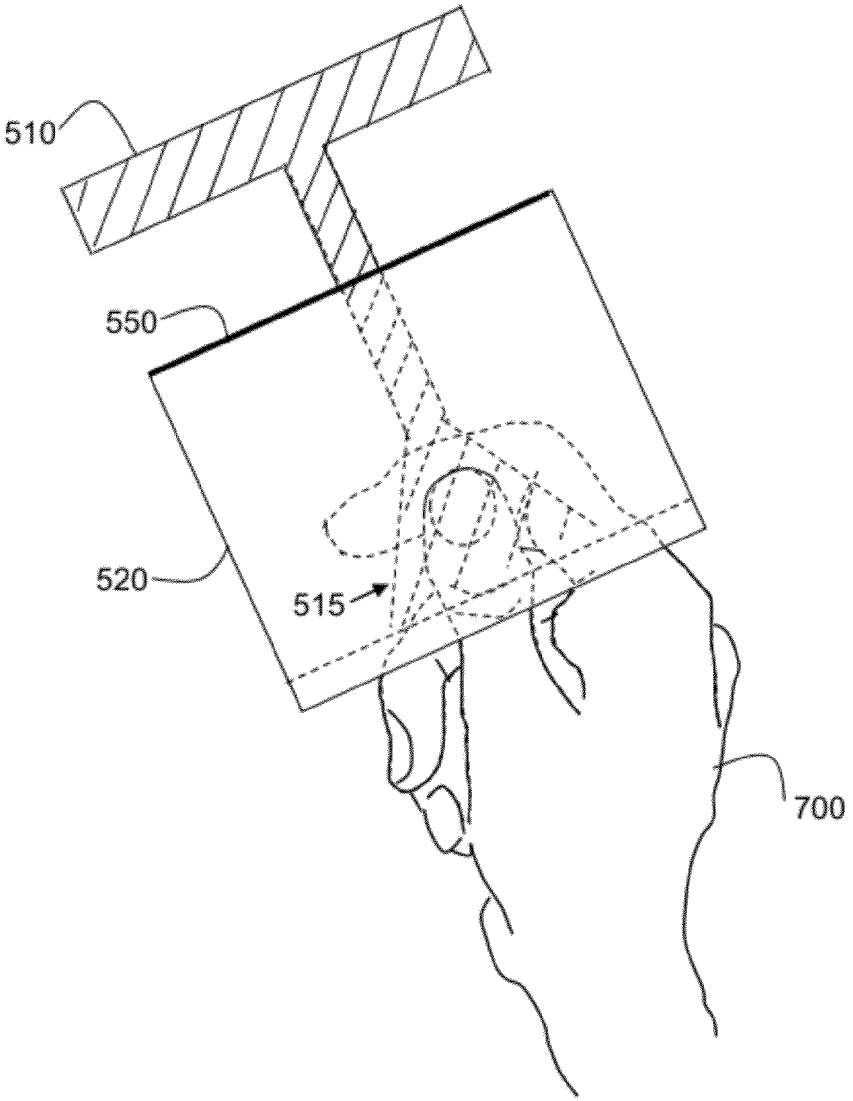
FIG. 7 illustrates how the condiment packet of FIGS. 5A-5B and FIG. 6 may be gripped by a user's hand to accomplish the spreading of the condiment.

FIG. 7 illustrates how the condiment packet 500 of FIGS. 5A-5B and FIG. 6 may be gripped by a user's hand 700 to accomplish the spreading of the condiment. The user may grip the condiment packet at the lower portion 515 of the spreading apparatus 510, for example, between a thumb of the user and an index finger of the user as shown in FIG. 7. In this manner, the user's hand 700 grips the outside surfaces of the sides 520 and 521 of the condiment packet 500 while the inside surfaces of the peeled back portions of the sides 520 and 521 of the condiment packet 500 lay over the user's hand 700 such that residue condiment remaining on the inside surfaces does not come in contact with the user's hand 700. The condiment packet 500 is opened and used in the manner described in FIG. 4.

Figure 8:
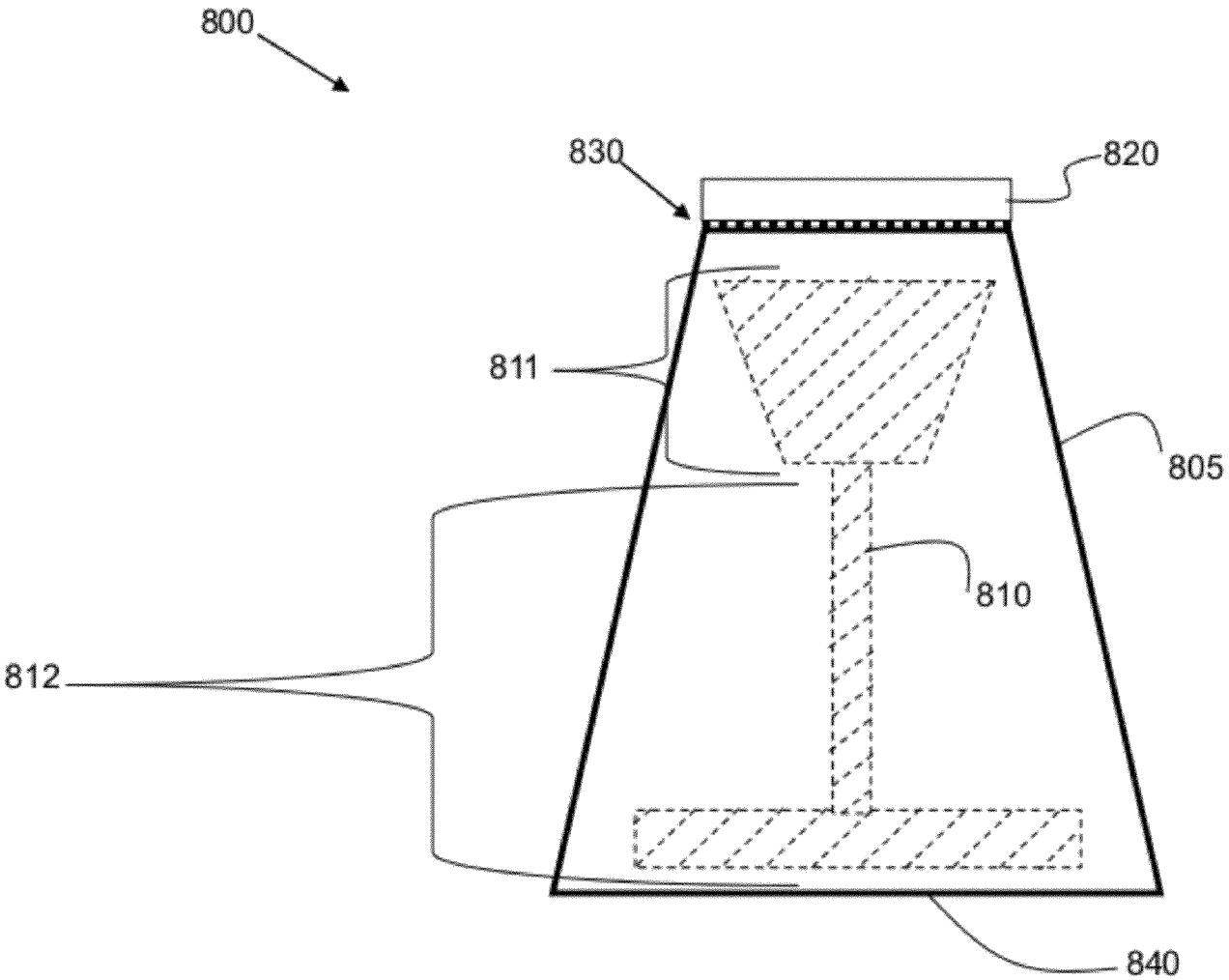
FIG. 8 illustrates another example of an embodiment of a condiment packet having a spreading apparatus therein.

FIG. 8 illustrates another example of an embodiment of a condiment packet 800 having a spreading apparatus 810 therein. The condiment packet 800 is similar to the condiment packet 100 of FIGS. 1A-1B in that the condiment packet 800 includes a substantially flat, sealed pouch 805 having two prominent sides, and a sealing strip 820 that is removably affixed at one end of the condiment packet 800. However, the overall shape of the condiment packet is substantially trapezoidal instead of rectangular. As a result, a first end 830 of the condiment packet 800 is narrower than a second end 840 of the condiment packet 800.

The spreading apparatus 810 is free-floating within the condiment packet 800. That is, the spreading apparatus 810 is not fixed to any portion of the sealed pouch 805 but, instead, is free to move, in a limited sense, within the sealed pouch 805 along with the condiment. The spreading apparatus 810 includes a first portion 811 and a second portion 812 connected to the first portion 811. For example, the first portion 811 and the second portion 812 may be a single molded plastic piece.

Figure 9:
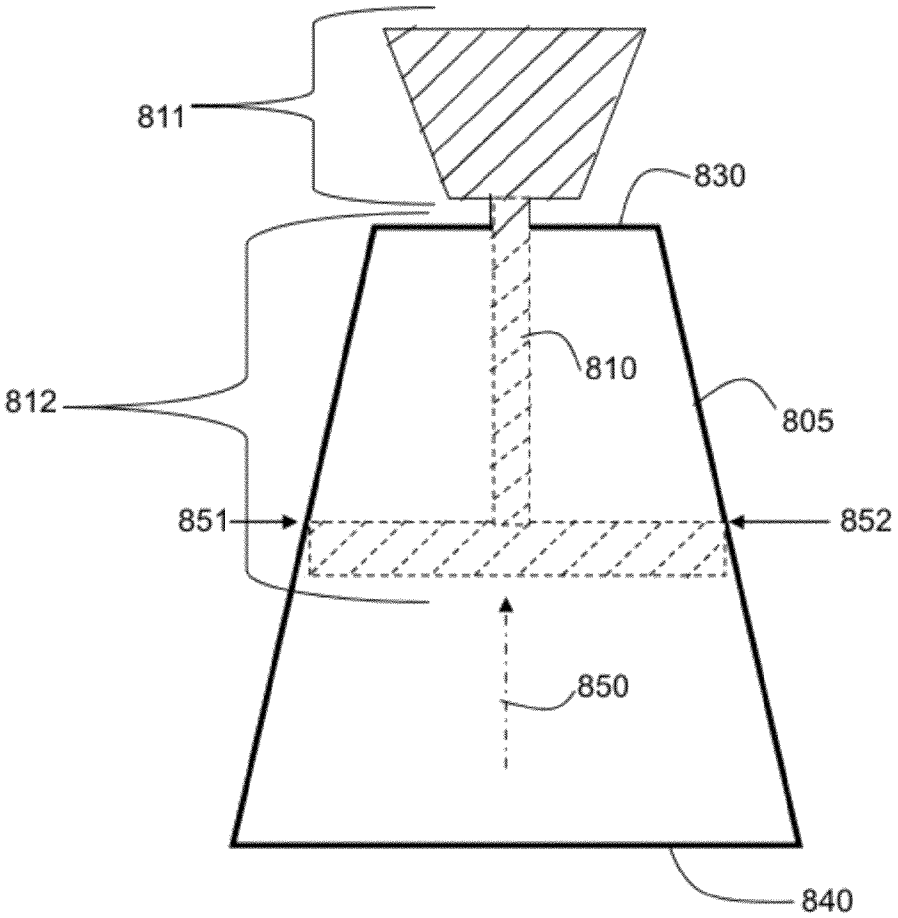
FIG. 9 illustrates the condiment packet of FIG. 8, after the condiment packet has been opened and the spreading apparatus has been slid out of an opened end of the condiment packet, showing a resulting exposed first portion of the spreading apparatus.

FIG. 9 illustrates the condiment packet 800 of FIG. 8, after the condiment packet has been opened (i.e., the sealing strip 820 has been removed) and a portion of the spreading apparatus 810 has been slid out of an opened end 830 of the condiment packet, showing a resulting exposed first portion 811 of the spreading apparatus 810. When the open condiment packet is squeezed by a user starting near the closed end 840, the condiment and the spreading apparatus 810 move toward the open end 830 in the general direction 850. The outer surface of the condiment packet 800 may be gripped by a user at the second portion 812 of the spreading apparatus 810, and the first portion 811 of the spreading apparatus 810 may be manipulated to spread the condiment over a food substance.

Figure 10:
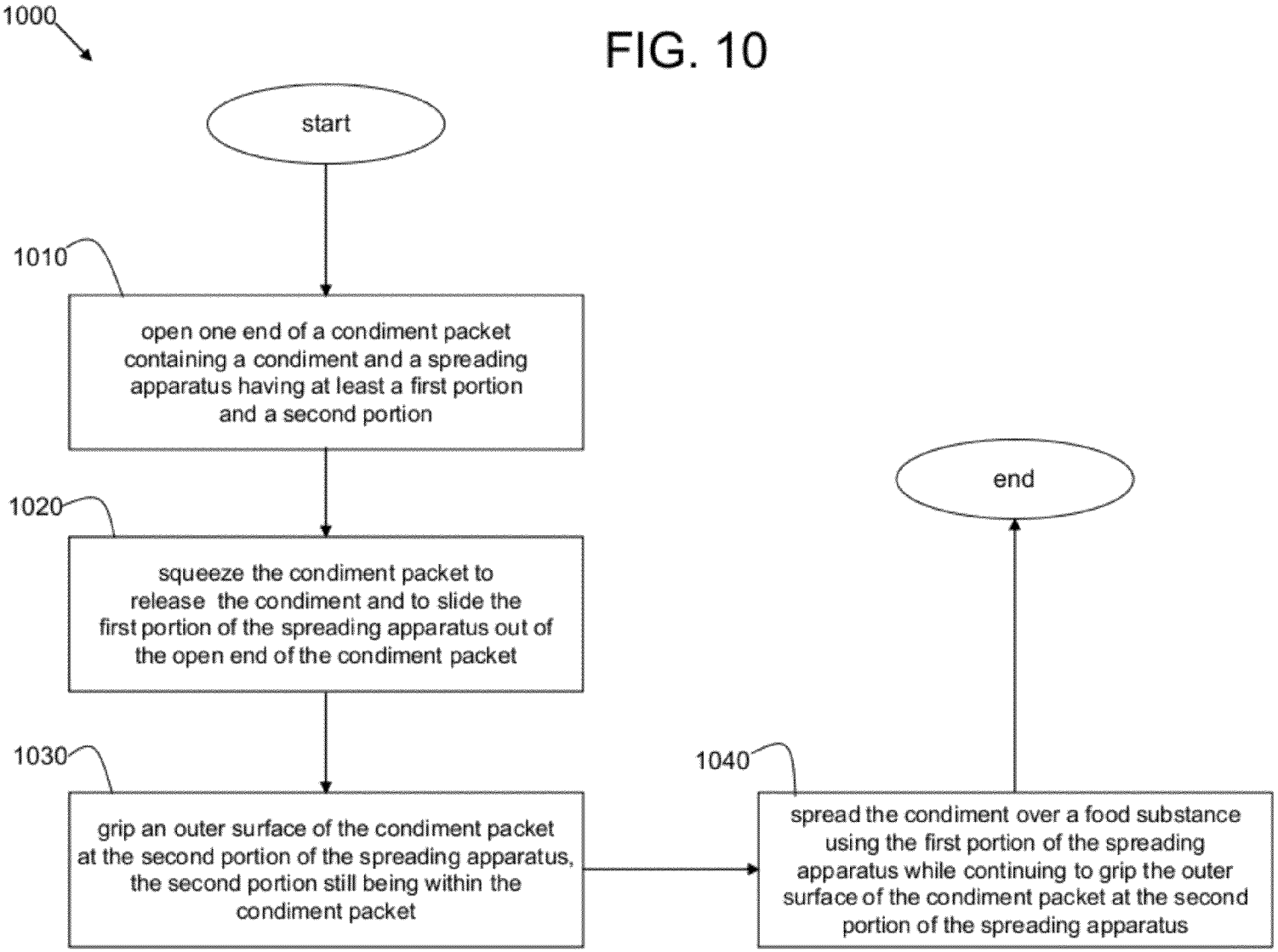
FIG. 10 is a flow chart of an example of an embodiment of a method of opening and using the condiment packet of FIG. 8.

FIG. 10 is a flow chart of an example of an embodiment of a method 1000 of opening and using the condiment packet 800 of FIG. 8. In step 1010, open one end 830 of a condiment packet 800 containing a condiment and a spreading apparatus 810 having at least a first portion 811 and a second portion 812. In step 1020, squeeze the condiment packet 800 to release the condiment and to slide the first portion 811 of the spreading apparatus 810 out of the open end 830 of the condiment packet 800. In step 1030, grip an outer surface of the condiment packet 800 at the second portion 812 of the spreading apparatus 810, the second portion 812 still being within the condiment packet 800. In step 1040, spread the condiment over a food substance using the first portion 811 of the spreading apparatus 810 while continuing to grip the outer surface of the condiment packet 800 at the second portion 812 of the spreading apparatus 810.

When the spreading apparatus 810 is squeezed toward the open end 830 of the condiment packet 800, the movement of the spreading apparatus 810 in the general direction 850 is eventually stopped at the stopping points 851 and 852 as the distal end of spreading apparatus 810 makes contact with the interior edges of the condiment packet 800. This is because the width of the pouch 805 becomes narrower as the spreading apparatus 810 moves toward the open end 830. The distal end of the spreading apparatus 810 has a width that matches the width of the pouch 805 at the stopping points 851 and 852. As a result, the spreading apparatus 810 is prevented from being completely removed from the opened pouch of the condiment packet 800. When finished spreading the condiment, the entire condiment packet 800, including the spreading apparatus 810, may be properly disposed of.

Figure 11:
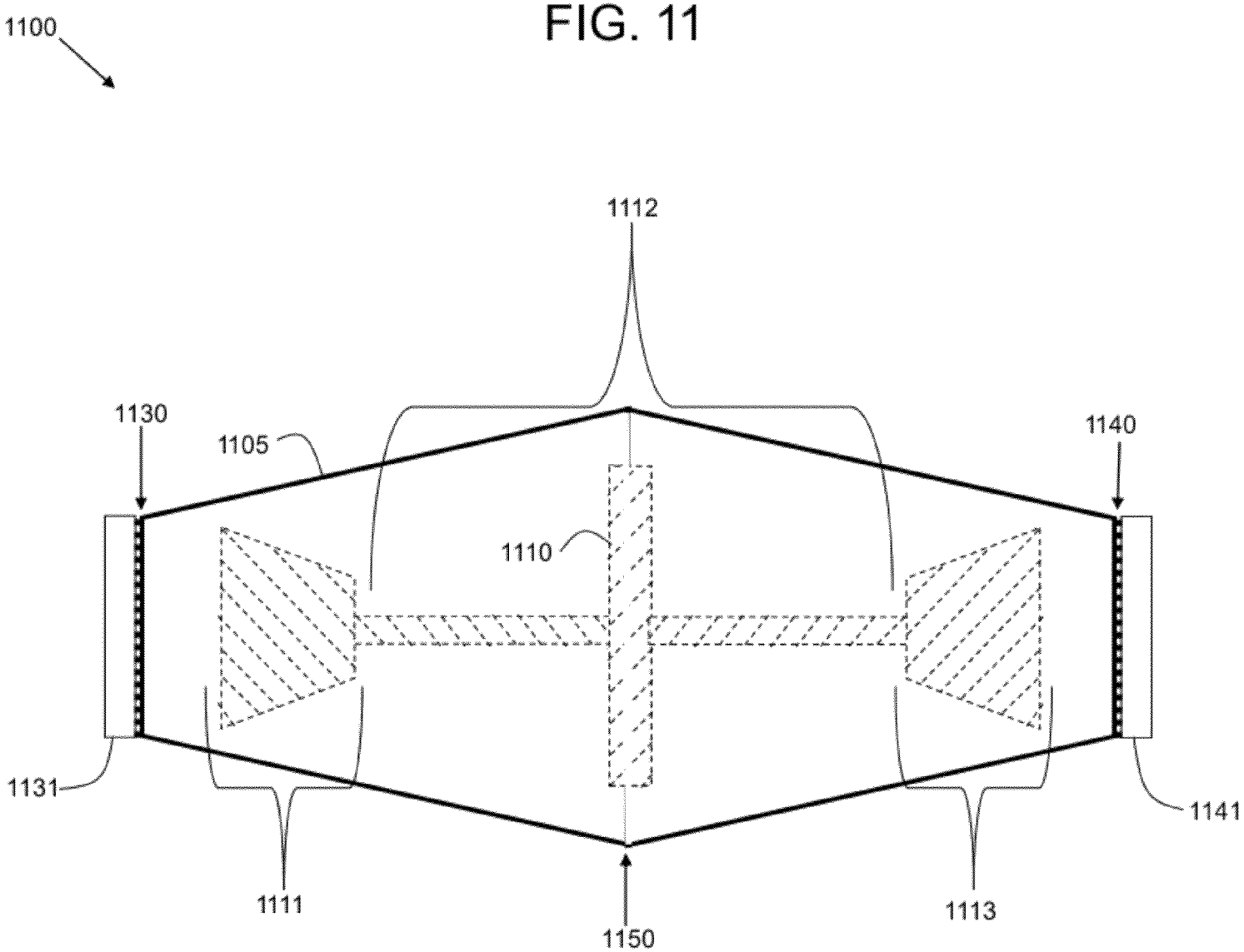
FIG. 11 illustrates another alternative example of an embodiment of a condiment packet having a spreading apparatus therein.

FIG. 11 illustrates another alternative example of an embodiment of a condiment packet 1100 having a spreading apparatus 1110 therein. With the condiment packet 1100 of FIG. 11, either end (1130 or 1140) of the condiment packet 1100 may be opened. The condiment packet 1100 is similar to the condiment packet 800 of FIG. 8 in that the condiment packet 800 includes a substantially flat, sealed pouch 1105 having two prominent sides. However, the condiment packet 1100 has two sealing strips 1131 and 1141, one on either end of the condiment packet 1100. Furthermore, the overall shape of the condiment packet 1100 is substantially double-trapezoidal instead of just trapezoidal. That is, the shape resembles two trapezoids abutted against each other. As a result, the ends 1130 and 1140 of the condiment packet 800 are narrower than the middle portion 1150 of the condiment packet 1100.

The spreading apparatus 1110 is free-floating within the condiment packet 1100. That is, the spreading apparatus 1110 is not fixed to any portion of the sealed pouch 1105 but, instead, is free to move, in a limited sense, within the sealed pouch 1105 along with the condiment. The spreading apparatus 1110 includes a first portion 1111, a second portion 1112 connected to the first portion 1111, and a third portion 1113 connected to the second portion 1112. For example, the first portion 1111, the second portion 1112, and the third portion 1113 may be a single molded plastic piece. The first portion 1111 is substantially the same as the third portion 1113. With such a condiment packet 1100, either end 1130 or end 1140 may be opened and either the first portion 1111 or the third portion 1113 of the spreading apparatus 1110 may be slid out of the corresponding opened end and used to spread the condiment. The condiment packet 1100 is opened and used in the manner described in FIG. 10.

Figure 12:
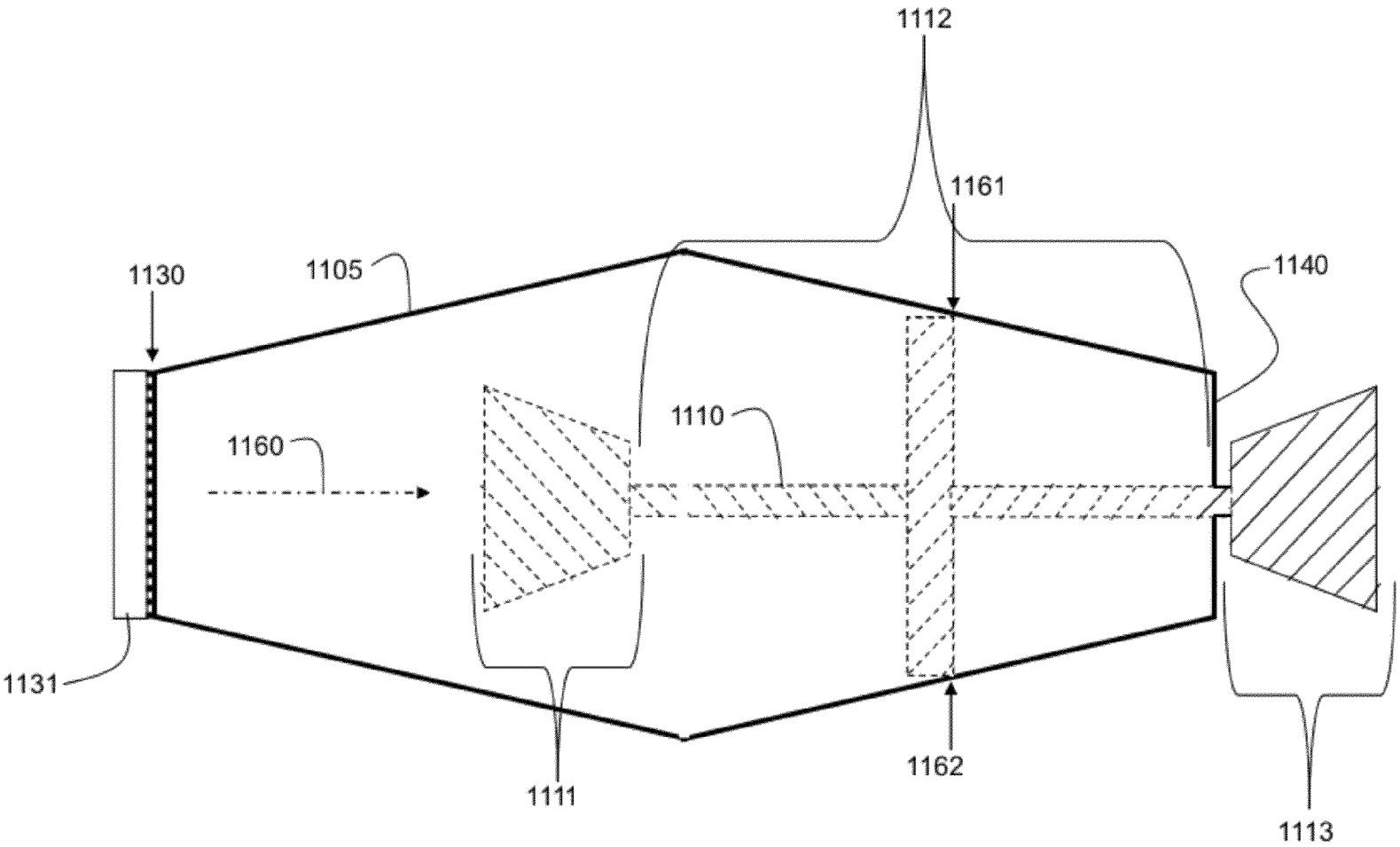
FIGS. 12 and 13 illustrate the condiment packet of FIG. 11, after the condiment packet 1100 has been opened and a portion of the spreading apparatus has been slid out of an opened end of the condiment packet, showing a resulting exposed portion of the spreading apparatus.
Figure 13:
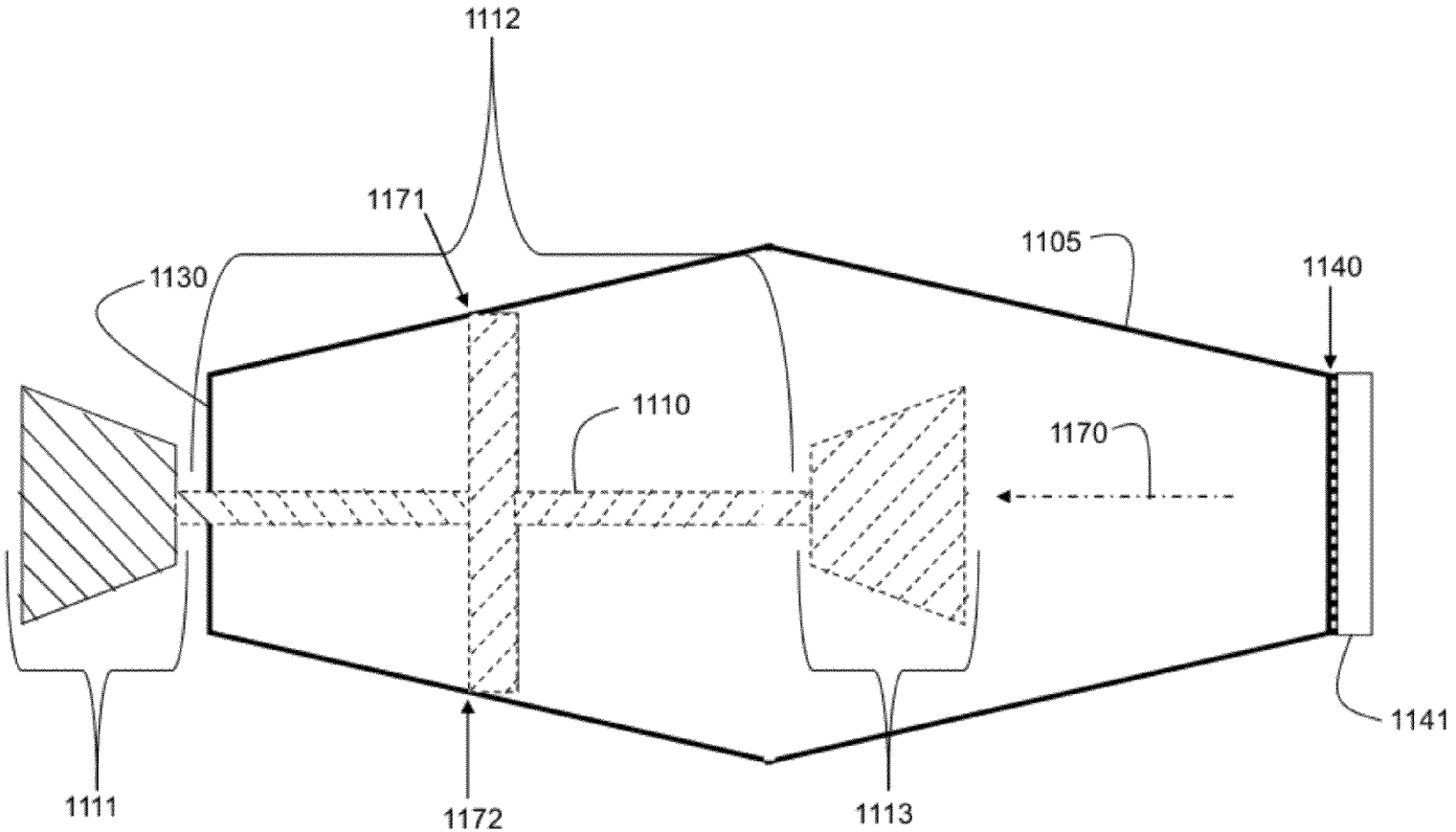

FIGS. 12 and 13 illustrate the condiment packet 1100 of FIG. 11, after the condiment packet 1100 has been opened (i.e., a sealing strip 1131 or 1141 has been removed) and a portion of the spreading apparatus 1110 has been slid out of an opened end of the condiment packet 1100, showing a resulting exposed portion (1111 or 1113) of the spreading apparatus 1110.

Referring to FIG. 12, end 1140 is opened. When the open condiment packet 1100 is squeezed starting near the closed end 1130, the condiment and the spreading apparatus 1110 move toward the open end 1140 in the general direction 1160. The outer surface of the condiment packet 1100 may be gripped by a user at the second portion 1112 and/or at the first portion 1111 of the spreading apparatus 1110, and the exposed third portion 1113 of the spreading apparatus 1110 may be manipulated to spread the condiment over a food substance.

When the spreading apparatus 1110 is squeezed toward the open end 1140 of the condiment packet 1100, the movement of the spreading apparatus 1110 in the general direction 1160 is eventually stopped at the stopping points 1161 and 1162 as the center portion of spreading apparatus 1110 makes contact with the interior edges of the pouch 1105. This is because the width of the condiment packet 1100 becomes narrower as the spreading apparatus 1110 moves toward the open end 1140. The center portion of the spreading apparatus 1110 has a width that matches the width of the pouch 1105 at the stopping points 1161 and 1162. As a result, the spreading apparatus 1110 is prevented from being completely removed from the opened pouch of the condiment packet 1100.

Similarly, referring to FIG. 13, end 1130 is opened. When the open condiment packet 1100 is squeezed starting near the closed end 1140, the condiment and the spreading apparatus 1110 move toward the open end 1130 in the general direction 1170. The outer surface of the condiment packet 1100 may be gripped by a user at the second portion 1112 and/or at the third portion 1113 of the spreading apparatus 1110, and the exposed first portion 1111 of the spreading apparatus 1110 may be manipulated to spread the condiment over a food substance.

When the spreading apparatus 1110 is squeezed toward the open end 1130 of the condiment packet 1100, the movement of the spreading apparatus 1110 in the general direction 1170 is eventually stopped at the stopping points 1171 and 1172 as the center portion of spreading apparatus 1110 makes contact with the interior edges of the pouch 1105. This is because the width of the condiment packet 1100 becomes narrower as the spreading apparatus 1110 moves toward the open end 1130. The center portion of the spreading apparatus 1110 has a width that matches the width of the pouch 1105 at the stopping points 1171 and 1172. As a result, the spreading apparatus 1110 is prevented from being completely removed from the opened pouch of the condiment packet 1100.

A condiment packet, in accordance with other embodiments of the present invention, may be of other shapes such as, for example, a triangular shape, a tapered rectangular shape, or a bottle shape.

Figure 14:
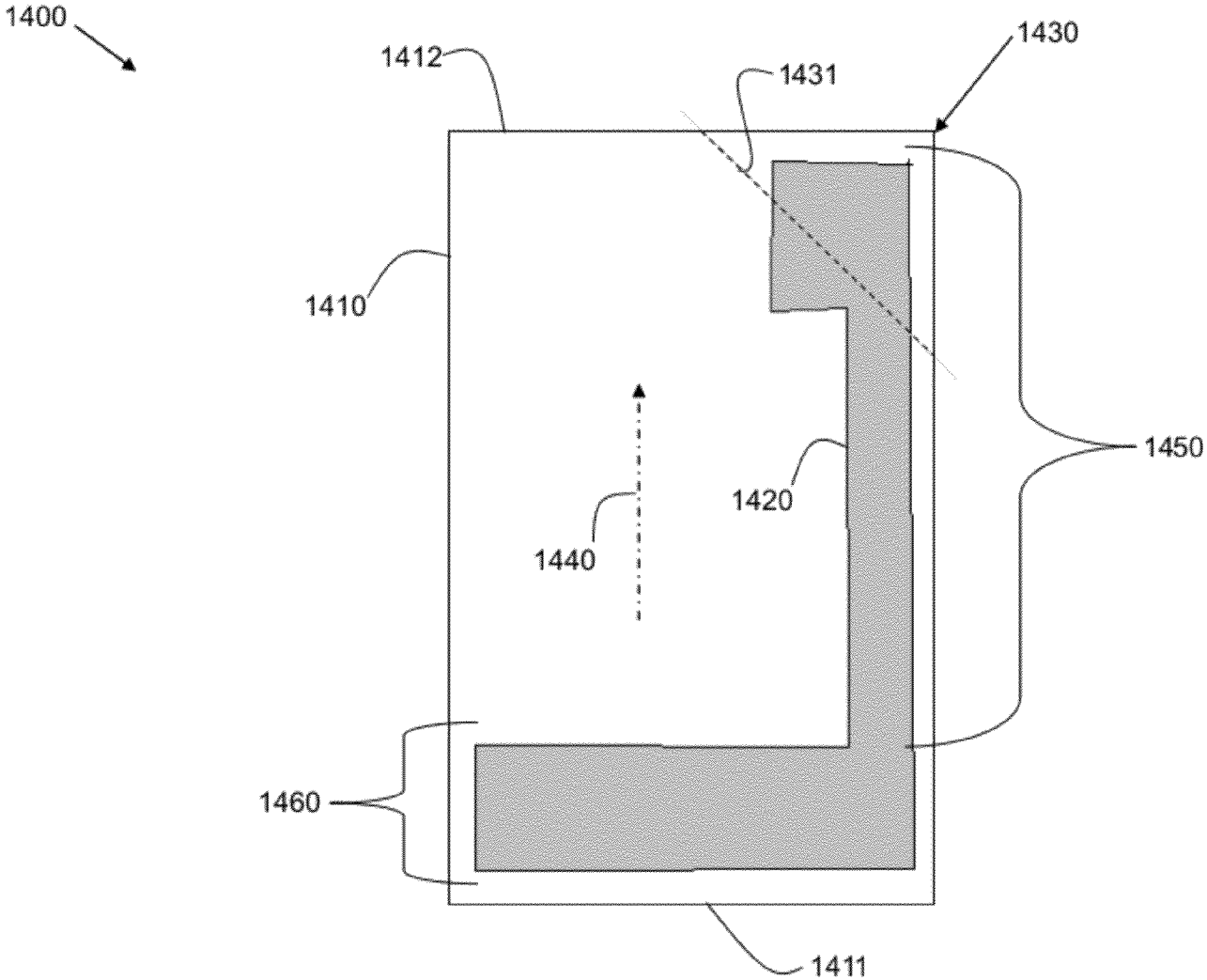
FIG. 14 illustrates a further example embodiment of a condiment packet having a spreading apparatus and a condiment therein.

FIG. 14 illustrates a further example embodiment of a condiment packet 1400 having a spreading apparatus 1420 and a condiment therein. FIG. 14 shows a condiment packet 1400 including a sealed pouch 1410 and a spreading apparatus 1420 free-floating inside the sealed pouch 1410. The spreading apparatus is substantially J-shaped and includes a first portion 1450 and a second portion 1460. The sealed pouch 1410 is designed to be opened at the corner 1430 by, for example, tearing the pouch 1410 along the tear line 1431.

When the pouch 1410 of the condiment packet 1400 is opened at the corner 1430, the pouch 1410 may be squeezed starting near the edge 1411 to force the condiment and the spreading apparatus to move substantially in the general direction 1440 toward the opposite edge 1412 of the pouch 1410. As a result, the condiment and the first portion 1450 of the spreading apparatus 1420 exits through the opening at the corner 1430. The first portion 1450 of the spreading apparatus 1420 is narrow enough to exit the pouch 1410 at the corner 1430. However, the second portion 1460 it too wide to exit the pouch 1410. Therefore, the spreading apparatus 1420 is prevented from totally exiting the pouch 1410. The outer surface of the pouch 1410 may then be gripped at the second portion 1460 of the spreading apparatus 1420, which is now near the upper edge 1431 of the pouch 1410 (but still substantially within the pouch 1410), and the first portion 1450 of the spreading apparatus 1420 may be used to spread the condiment over a food substance.

Figure 15:
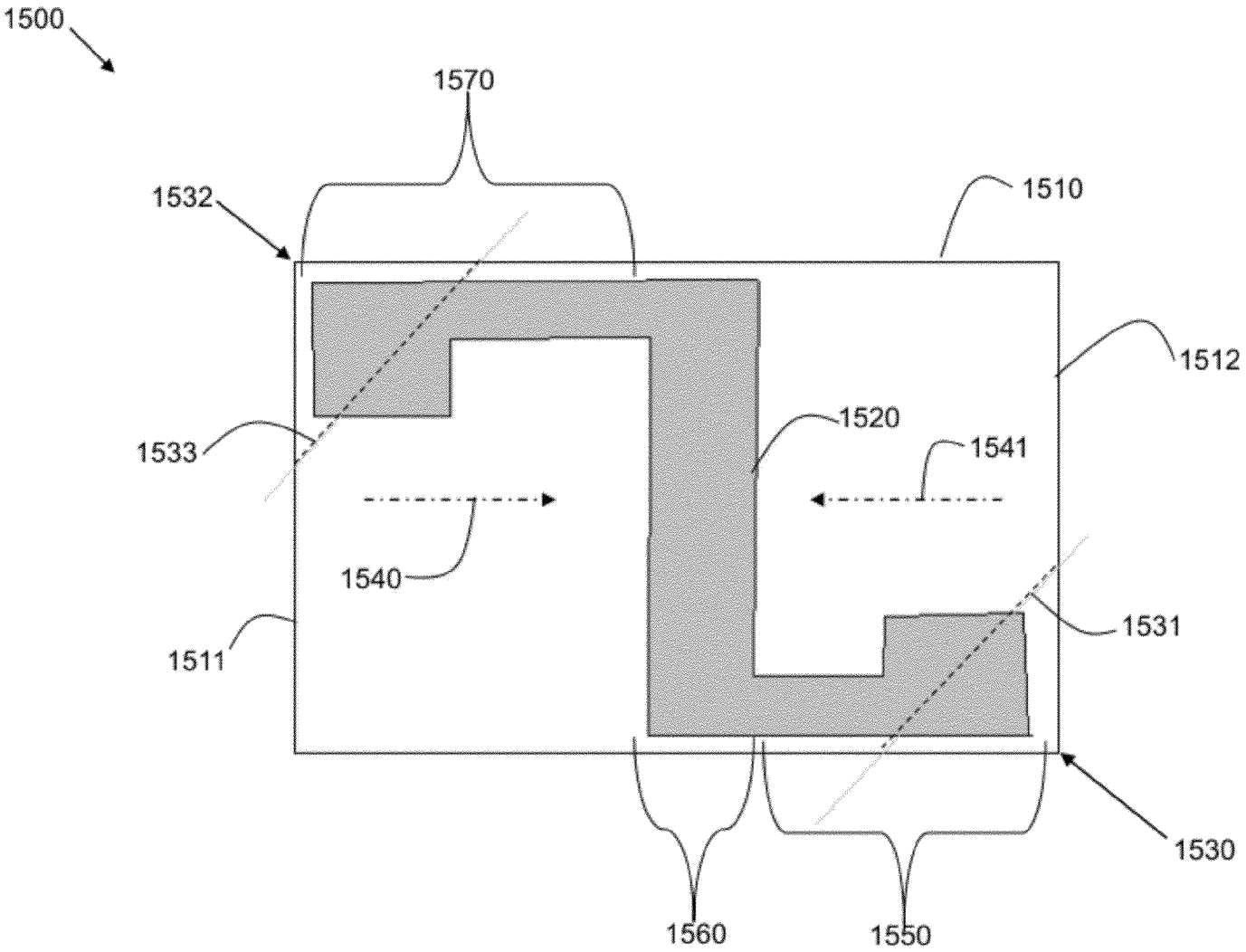
FIG. 15 illustrates still a further example embodiment of a condiment packet having a spreading apparatus and a condiment therein.

FIG. 15 illustrates still a further example embodiment of a condiment packet 1500 having a spreading apparatus 1520 and a condiment therein. The condiment packet 1500 of FIG. 15 is similar to the condiment packet 1400 of FIG. 14 except that the spreading apparatus 1520 has three portions instead of two portions, where the third portion is similar to the first portion.

FIG. 15 shows a condiment packet 1500 including a sealed pouch 1510 and a spreading apparatus 1520 free-floating inside the sealed pouch 1510. The spreading apparatus 1520 is substantially Z-shaped and includes a first portion 1550, a second central portion 1560, and a third portion 1570. The sealed pouch 1510 is designed to be opened either at the corner 1530 by, for example, tearing the pouch 1510 along the tear line 1531, or at the corner 1532 by, for example, tearing the pouch 1510 along the tear line 1533.

When the pouch 1510 of the condiment packet 1500 is opened at the corner 1530, the pouch 1510 may be squeezed starting near the edge 1511 to force the condiment and the spreading apparatus 1520 to move substantially in the general direction 1540 toward the opposite edge 1512 of the pouch 1510. As a result, the condiment and the first portion 1550 of the spreading apparatus 1520 exits through the opening at the corner 1530. The first portion 1550 of the spreading apparatus 1520 is narrow enough to exit the pouch 1510 at the corner 1530. However, the second portion 1560 it too wide to exit the pouch 1510. Therefore, the spreading apparatus 1520 is prevented from totally exiting the pouch 1510. The outer surface of the pouch 1510 may then be gripped at the second portion 1560 and/or at the third portion 1570 of the spreading apparatus 1520, which are now nearer the edge 1512 of the pouch 1510, and the first portion 1550 of the spreading apparatus 1520 may be used to spread the condiment over a food substance.

As an alternative, the pouch 1510 of the condiment packet 1500 may be opened at the corner 1532, and the pouch 1510 may be squeezed starting near the edge 1512 to force the condiment and the spreading apparatus 1520 to move substantially in the general direction 1541 toward the opposite edge 1511 of the pouch 1510. As a result, the condiment and the third portion 1570 of the spreading apparatus 1520 exits through the opening at the corner 1532. The third portion 1570 of the spreading apparatus 1520 is narrow enough to exit the pouch 1510 at the corner 1532. However, the second portion 1560 it too wide to exit the pouch 1510. Therefore, the spreading apparatus 1520 is prevented from totally exiting the pouch 1510. The outer surface of the pouch 1510 may then be gripped at the second portion 1560 and/or at the first portion 1550 of the spreading apparatus 1520, which are now nearer the edge 1511 of the pouch 1510, and the third portion 1570 of the spreading apparatus 1520 may be used to spread the condiment over a food substance.

Again, when finished spreading the condiment, the entire condiment packet, including the spreading apparatus, may be properly discarded.

In summary, a condiment packet having a spreading apparatus, and a method of use thereof, are disclosed. The condiment packet includes a substantially flat, sealed pouch containing a condiment. The condiment packet further includes a spreading apparatus being within the sealed pouch. The spreading apparatus may be used to spread the condiment over a food substance once the condiment is squeezed onto the food substance and once a portion of the spreading apparatus is exposed.

While the claimed subject matter of the present application has been described with reference to certain embodiments, it will be understood by those skilled in the art that various changes may be made and equivalents may be substituted without departing from the scope of the claimed subject matter. In addition, many modifications may be made to adapt a particular situation or material to the teachings of the claimed subject matter without departing from its scope. Therefore, it is intended that the claimed subject matter not be limited to the particular embodiments disclosed, but that the claimed subject matter will include all embodiments falling within the scope of the appended claims.

What is claimed is:

1. A method of opening and using a condiment packet, said method comprising:

opening a proximal end of a condiment packet containing a condiment and a spreading apparatus;

squeezing said condiment packet to release said condiment out of said proximal end of said condiment packet and onto a food substance;

gripping an outer surface of said condiment packet at a first portion of said spreading apparatus within said condiment packet;

peeling back two sides of said condiment packet exposing a second portion of said spreading apparatus; and spreading said condiment over said food substance using said second portion of said spreading apparatus while continuing to grip said outer surface of said condiment packet at said first portion of said spreading apparatus.

2. The method of claim 1 wherein said first portion of said spreading apparatus is located substantially along at least a portion of an internal edge of said condiment packet and is affixed thereto.

3. The method of claim 1 wherein said spreading apparatus is substantially more rigid than said condiment packet.

4. A condiment packet comprising:

a substantially flat, sealed pouch having two prominent sides and containing a condiment; and a spreading apparatus being within said sealed pouch, wherein at least a portion of said spreading apparatus is affixed to an internal portion of said sealed pouch preventing said spreading apparatus from coming removed from said sealed pouch.

5. The condiment packet of claim 4 further comprising a sealing strip removably affixed at a proximal end of said condiment packet.

6. The condiment packet of claim 4 further comprising two peeling tabs, one on either prominent side of said condiment packet, at a same corner of said condiment packet.

7. The condiment packet of claim 4 further comprising a peel-back crease on both prominent sides of said condiment packet wherein each said peel-back crease defines a boundary to which said prominent sides may be peeled back to.

8. The condiment packet of claim 4 wherein said two prominent sides are made of at least one of plastic, cellophane, and aluminum foil.

9. The condiment packet of claim 4 wherein said spreading apparatus is made of a plastic material that is more rigid than said prominent sides.

10. The condiment packet of claim 4 wherein said spreading apparatus is affixed to said sealed pouch along at least a portion of an internal edge of said sealed pouch formed by said two prominent sides.

* * * * *